US011112160B2

(12) United States Patent
Hong et al.

(10) Patent No.: US 11,112,160 B2
(45) Date of Patent: Sep. 7, 2021

(54) REFRIGERATOR

(71) Applicant: LG Electronics Inc., Seoul (KR)

(72) Inventors: Taehwa Hong, Seoul (KR); Hyuksoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 302 days.

(21) Appl. No.: 16/091,825

(22) PCT Filed: Apr. 6, 2017

(86) PCT No.: PCT/KR2017/003785

§ 371 (c)(1),
(2) Date: Oct. 5, 2018

(87) PCT Pub. No.: WO2017/176073

PCT Pub. Date: Oct. 12, 2017

(65) Prior Publication Data

US 2019/0101316 A1 Apr. 4, 2019

(30) Foreign Application Priority Data

Apr. 7, 2016 (KR) ..... 10-2016-0043010

(51) Int. Cl.
*F25C 5/20* (2018.01)
*F25B 21/02* (2006.01)
(Continued)

(52) U.S. Cl.
CPC ..... *F25C 5/22* (2018.01); *F25B 21/02* (2013.01); *F25D 11/02* (2013.01); *F25D 17/08* (2013.01);
(Continued)

(58) Field of Classification Search
CPC ..... F25D 23/02; F25D 23/04; F25D 23/06; F25D 23/028; F25D 25/02; F25D 17/08;
(Continued)

(56) References Cited

U.S. PATENT DOCUMENTS

2006/0000221 A1* 1/2006 Culp ..... F25B 21/02 62/3.6
2014/0150467 A1* 6/2014 Boarman ..... F25B 21/02 62/3.63
2014/0165603 A1* 6/2014 Boarman ..... F25C 1/10 62/3.3

FOREIGN PATENT DOCUMENTS

EP 2738485 6/2014
EP 2743609 6/2014
(Continued)

OTHER PUBLICATIONS

International Search Report in International Application No. PCT/KR2017/003785, dated Jul. 21, 2017, 4 pages.
(Continued)

*Primary Examiner* — Frantz F Jules
*Assistant Examiner* — Webeshet Mengesha
(74) *Attorney, Agent, or Firm* — Fish & Richardson P.C.

(57) ABSTRACT

A refrigerator includes: a cabinet; a door; an ice-making compartment mounted on an interior of the cabinet or on a back surface of the door, the ice-making compartment having an ice-making chamber and a cold air discharge hole; an ice tray located in the ice-making compartment; an ice bin arranged beneath the ice tray; a dispenser located at the door; a discharge duct located inside the door, the discharge duct having an entrance communicating with the ice-making compartment and an exit communicating with the dispenser; a thermoelectric element coupled to a bottom surface of the ice tray; a heat-radiating member forced against the thermoelectric element; and a cold air guide mounted on the bottom surface, the cold air guide defining a space that receives the thermoelectric element and the heat-radiating member, a cold air inlet, and a cold air outlet that communicates with the cold air discharge hole.

13 Claims, 8 Drawing Sheets

(51) Int. Cl.

| | |
|---|---|
| ***F25D 17/08*** | (2006.01) |
| ***F25D 11/02*** | (2006.01) |
| ***F25D 23/06*** | (2006.01) |
| ***F25D 23/02*** | (2006.01) |
| ***F25D 25/02*** | (2006.01) |

(52) U.S. Cl.
CPC ..... *F25D 23/02* (2013.01); *F25D 23/06* (2013.01); *F25D 25/02* (2013.01); *F25C 2400/10* (2013.01); *F25C 2500/08* (2013.01)

(58) Field of Classification Search
CPC ..... F25D 17/02; F25C 5/22; F25B 25/005; F25B 21/02
See application file for complete search history.

(56) References Cited

FOREIGN PATENT DOCUMENTS

| | | | |
|---|---|---|---|
| JP | H05327032 | | 12/1993 |
| JP | H06294560 | | 10/1994 |
| KR | 10-2008-0014598 | * | 2/2008 |
| KR | 1020080014598 | | 2/2008 |
| KR | 100814687 | | 3/2008 |
| KR | 10-2011-0072506 | * | 6/2011 |
| KR | 1020110072506 | | 6/2011 |

OTHER PUBLICATIONS

EP Supplementary Search Report in European Application No. EP 17779373, dated Oct. 24, 2019, 7 pages.

* cited by examiner

REFRIGERATOR

CROSS-REFERENCE TO RELATED APPLICATIONS

This application is a National Stage application under 35 U.S.C. § 371 of International Application No. PCT/KR2017/003785, filed on Apr. 6, 2017, which claims the benefit of Korean Application No. 10-2016-0043010, filed on Apr. 7, 2016. The disclosures of the prior applications are incorporated by reference in their entirety.

TECHNICAL FIELD

The present invention relates to a refrigerator.

BACKGROUND ART

Referring to Korean Patent No. 10-0814687, which is a prior art document, and FIG. 7 and the description related to FIG. 7 in the document, a configuration in which an ice making compartment is disposed on the rear side of a refrigerator door and an ice maker is disposed in the ice making compartment is disclosed.

In detail, a thermoelectric element is disposed on the bottom of an ice making container to increase ice making efficiency of the ice maker in the document.

The refrigerator disclosed in the document has the following problems.

In detail, a heat absorbing surface of the thermoelectric element is in close contact with the bottom of the ice making container and a heat dissipating surface thereof is positioned opposite to the heat absorbing surface. However, the heat-dissipating side exchanges heat with cold air in the ice making compartment, thereby increasing the temperature in the ice making compartment.

An ice bin where ices are kept is disposed below the ice making container and the cold air that has exchanged heat with the heat dissipating surface of the thermoelectric element flows to the ice bin. Accordingly, the ices kept in the ice bin may melt and stick to one another. Therefore, there may be a problem that ices are not smoothly discharged through a dispenser and a desired amount of ices are not discharged.

DISCLOSURE

Technical Problem

The present invention has been made in an effort to solve the problems.

Technical Solution

In order to achieve the objects of the present invention, a refrigerator according to an embodiment of the present invention may include: a cabinet having a storage space and an evaporation compartment therein; a door coupled to the front side of the cabinet to open or close the storage space; an ice making compartment mounted in the storage space or on a rear side of the door, the ice making compartment having: an ice making chamber therein; and a cold air exhaust hole formed in a surface thereof; an ice tray disposed in the ice making compartment; an ice bin disposed below the ice tray; a dispenser disposed on the front side of the door to dispense ices; and a discharge duct disposed in the door and having an inlet end communicating with the ice making compartment and an outlet end communicating with the dispenser.

In detail, the refrigerator includes: a thermoelectric module having one side surface in close contact with a bottom of the ice tray; a heat dissipating member being in close contact with the other side surface of the thermoelectric module; and a cold air guide mounted on the bottom of the ice tray, the cold air guide having: a space therein for accommodating the thermoelectric module and the heat dissipating member; a cold air inlet; and a cold air outlet, in which the cold air outlet is connected with the cold air exhaust hole.

Advantageous Effects

The refrigerator having this configuration according to an embodiment of the present invention has the following effects.

In detail, the thermoelectric module is mounted on the bottom of the ice tray and is accommodated in a cold air guide mounted on the bottom of the ice tray. An outlet end of the cold air guide communicates with an exhaust duct formed on a side of the ice making compartment. The exhaust duct is connected with a cold air return duct connected to a side of the cabinet. Accordingly, cold air that has increased in temperature by exchanging heat with a heat dissipating side of the thermoelectric module is discharged to a freezer compartment through the cold air guide, the exhaust duct, and the cold air return duct.

As described above, the cold air that has increased in temperature by absorbing heat is guided to the freezer compartment without remaining in the ice making compartment, a phenomenon in which the internal temperature of the ice making compartment is increased by heat from the heat dissipating side of the thermoelectric module does not occur. Accordingly, it is possible to prevent ices from melting and sticking to each other in the ice bin.

Further, the ice making compartment according to an embodiment of the present invention is mounted on the rear side of the refrigerator compartment door and is isolated from cold air in the refrigerator compartment by the case filled with a heat insulating member. Further, the cold air in the refrigerator compartment does not flow into the ice making compartment or the cold air in the ice making compartment is not discharged into the refrigerator compartment. Therefore, there is the advantage that even though the ice making compartment is disposed in the storage compartment that is lower in temperature than the ice making compartment, the internal temperature of the ice making compartment is not increased.

MODE FOR INVENTION

Hereinafter, a refrigerator according to an embodiment of the present invention is described in detail with reference to drawings.

Figure 1:
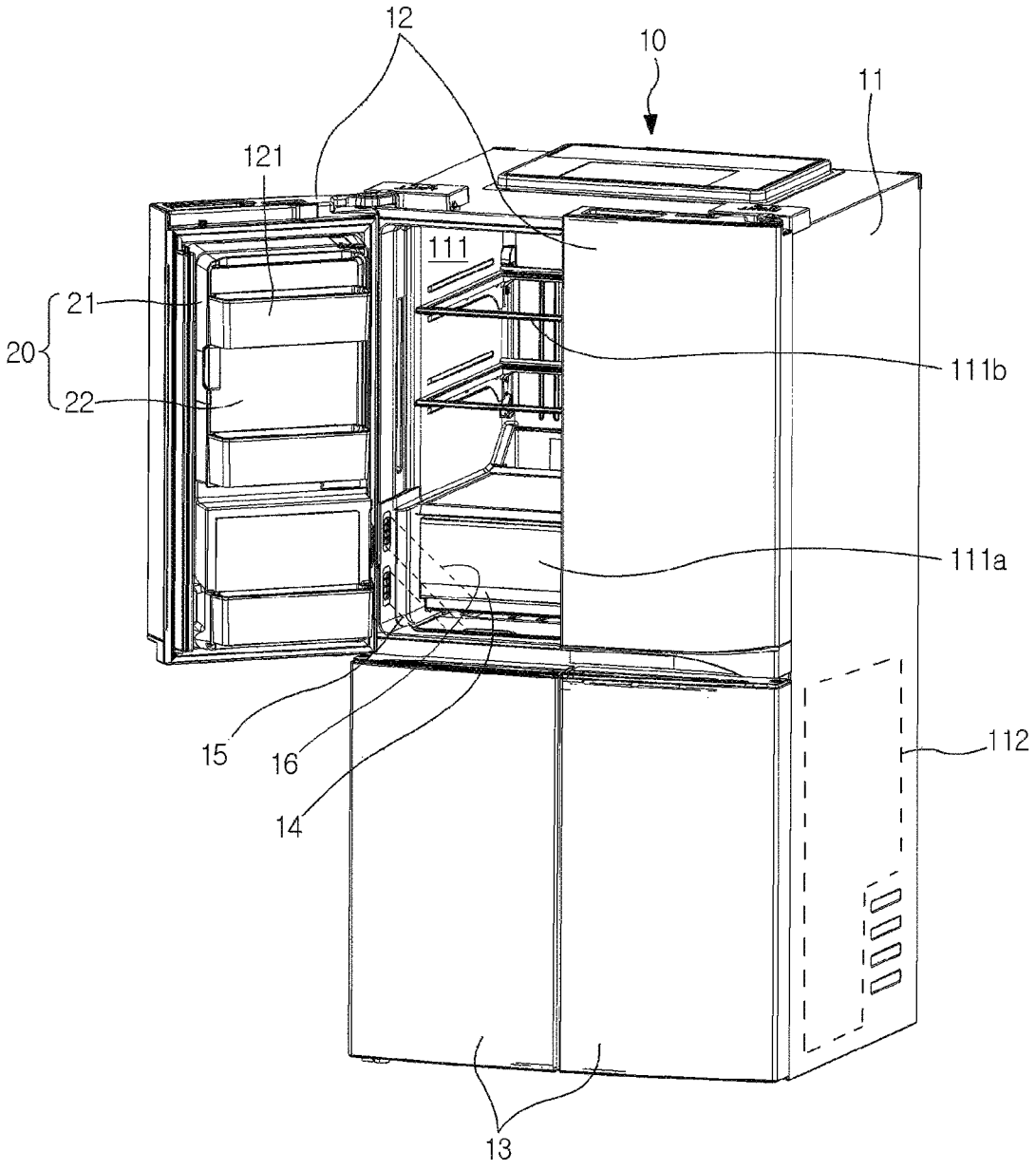
FIG. 1 is a perspective view showing a refrigerator according to an embodiment of the present invention with an ice making compartment door closed.
Figure 2:
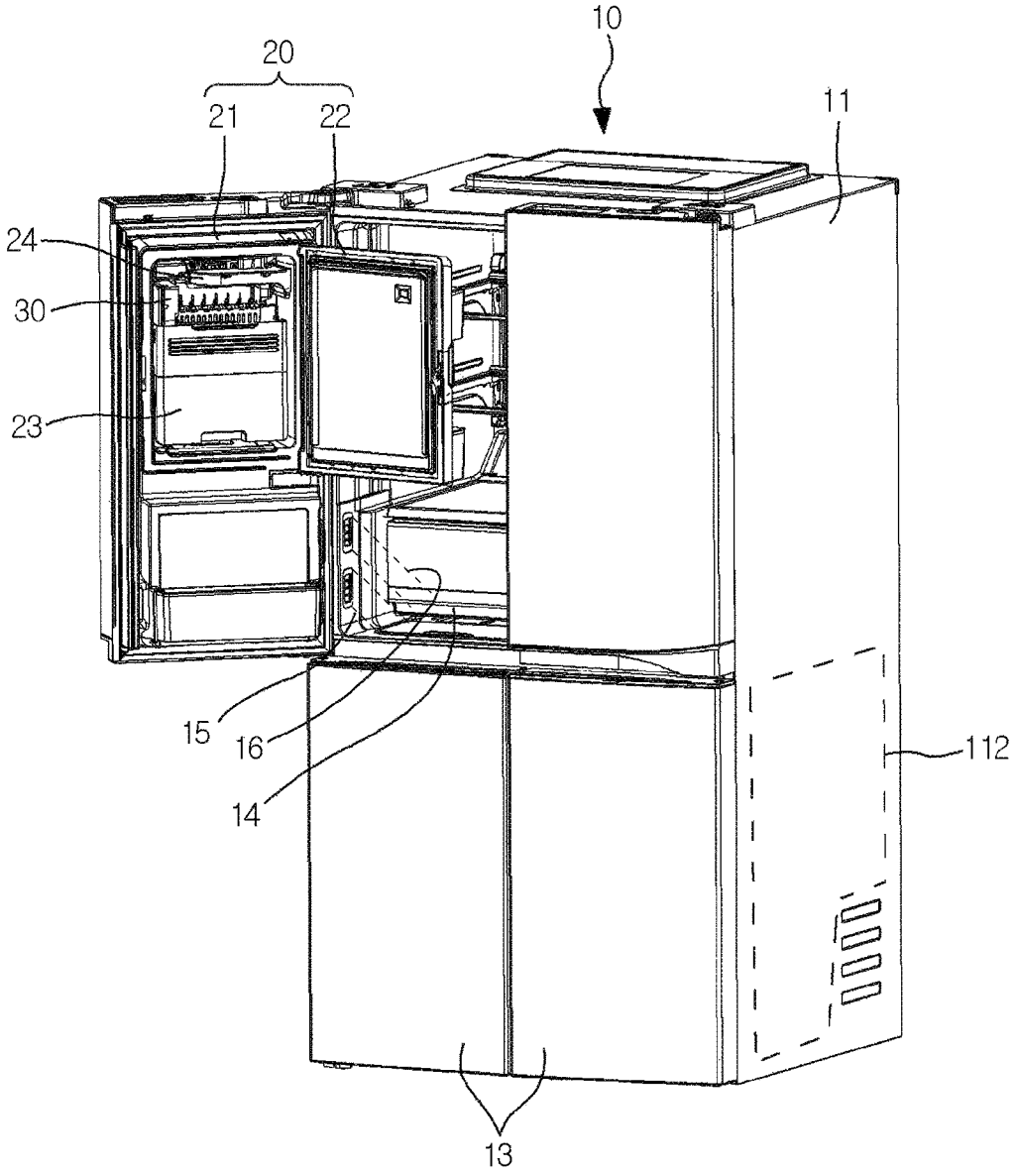
FIG. 2 is a perspective view showing the refrigerator with the ice making compartment door open.

FIG. 1 is a perspective view showing a refrigerator according to an embodiment of the present invention with an ice making compartment door closed and FIG. 2 is a perspective view showing the refrigerator with the ice making compartment door open.

Referring to FIGS. 1 and 2, a refrigerator 10 according to an embodiment of the present invention may include a cabinet 11 having a storage space therein and a door for opening or closing the storage space.

In detail, the storage space may include a refrigerator compartment 111 that keeps food cold and a freezer compartment 112 that keeps food frozen. The door may include a refrigerator compartment door 12 that opens or closes the refrigerator compartment 111 and a freezer compartment door 13 that opens or closes the freezer compartment 112.

The refrigerator compartment door 12 and the freezer compartment door 13 can be rotatably coupled to edges of the front side of the cabinet 11. The refrigerator compartment door 12 and the freezer compartment door 13 each may include a pair of rotary doors.

An ice making compartment 20 may be disposed on the rear side of any one of the pair of refrigerator compartment door 12. The ice making compartment 20 may include a case 21 formed by a door liner defining the rear side of the refrigerator compartment door 12 and an ice making compartment door 22 rotatably coupled to the case 21.

In detail, a door dike where a portion of the door liner protrudes is formed at the edge of the rear side of the refrigerator compartment door 12. The case 21 includes the portion of the door liner and door dike that define the rear side of the refrigerator compartment door 12. An ice making chamber 201 is formed in the case 21. An ice making duct 24, an ice maker assembly 30, and an ice bin 23 are disposed in the ice making chamber 201. The ice maker assembly 30 is disposed below the ice making duct 24 and the ice bin 23 is disposed below the ice maker assembly 30. The ice maker assembly 30 is mounted at the upper portion in the ice making chamber 201 and the ice bin 23 is disposed below the ice maker assembly 30.

A dispenser is disposed below the ice making compartment 20, in detail, below the case 21 and may be recessed a predetermined depth rearward from a front surface of the refrigerator compartment door 12. A discharge duct (not shown) is formed inside the refrigerator compartment door 12, with an inlet end communicating the bottom of the case 21 and an outlet end communicating with the top of the dispenser. An outlet is also formed through the bottom of the ice bin 23. When the ice bin 23 is mounted in the ice making chamber 201, the inlet end of the discharge duct, a hole formed through the bottom of the case 21, and the outlet formed through the bottom of the ice bin 23 communicate with one another. Further, a damper is disposed in the discharge duct, thus ices in the ice bin can be selectively discharged to the dispenser.

A cold air supply duct 14 and a cold air return duct 15 may be formed in a side wall of the cabinet 11. In detail, an inlet end of the cold air duct 14 communicates with an evaporation compartment disposed behind the freezer compartment 112 and an outlet end thereof is exposed on a side surface of the refrigerator compartment 111. The cold air return duct 15 has an inlet end exposed on a side surface of the refrigerator compartment 111 and an outlet end communicating with the freezer compartment 112 or the evaporation compartment. An evaporator that constitutes a refrigeration cycle is disposed in the evaporation compartment.

A cold air inlet and a cold air outlet are formed in the outer side surface of the side wall of the case 21 that defines the ice making compartment 20, in detail, on the surface facing a side surface of the refrigerator compartment 11 with the refrigerator compartment door 12 closed. When the refrigerator compartment door 12 is in a closed position, the cold air inlet communicates with the outlet end of the cold air supply duct 14 and the cold air outlet communicates with the inlet end of the cold air return duct 15.

A supply duct 26 (see FIG. 3) and an exhaust duct 25 (see FIG. 3) extend in the side wall of the case 21 where the cold air inlet and the cold air outlet are formed. An inlet end of the supply duct 26 communicates with the cold air inlet and an outlet end thereof communicates with the inlet end of the ice making duct 24.

An inlet end of the exhaust duct 25 communicates with an outlet end of a cold air guide 35 (see FIG. 3) to be described below and an outlet end thereof communicates with the cold air outlet.

A plurality of door baskets 121 vertically spaced apart from each other may be disposed on the front side of the ice making compartment door 22. A box 111*a* and a shelf 111*b* may be disposed in the refrigerator compartment 111.

According to this configuration, low-temperature cold air produced in the evaporation compartment is guided into the ice making compartment 20 through the cold air supply duct 14. The cold air in the ice making compartment 20 returns to the freezer compartment 112 or the evaporation compartment through the cold air return duct 15.

Figure 3:
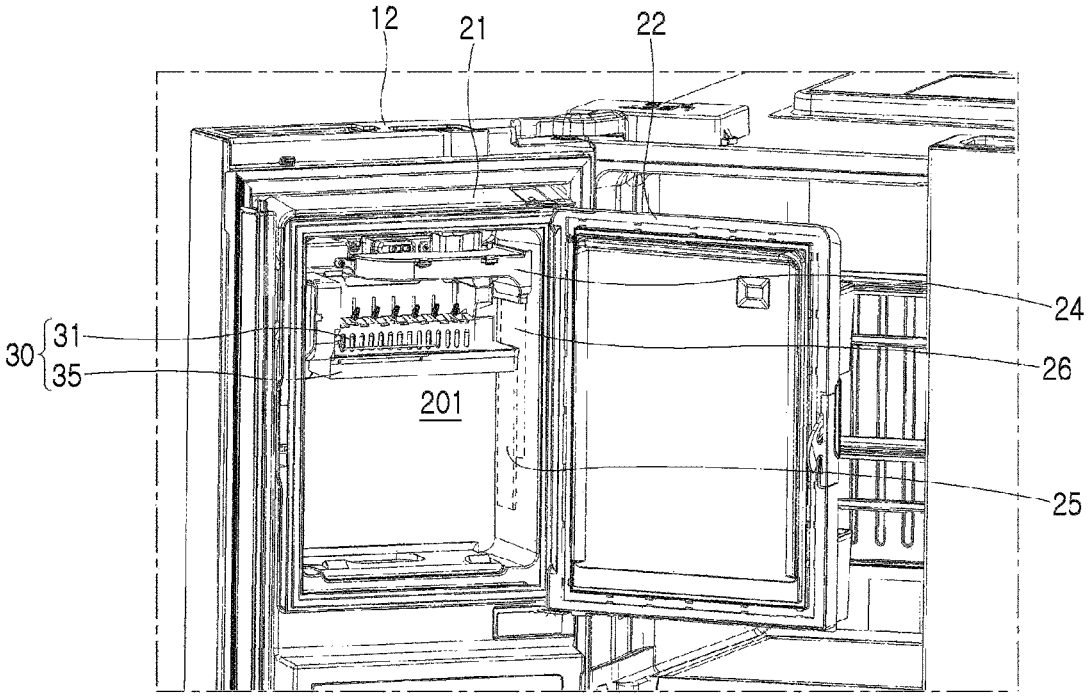
FIG. 3 is a partial perspective view showing the inside of the ice making compartment with an ice bin removed in the refrigerator according to an embodiment of the present invention.

FIG. 3 is a partial perspective view showing the inside of the ice making compartment with an ice bin removed in the refrigerator according to an embodiment of the present invention.

Referring to FIG. 3, the ice making duct 24 is disposed in the space adjacent to the top of the ice making chamber 201. The inlet end of the ice making duct 24 is in close contact with an inner side of the case 21. The outlet end of the supply duct 26 is formed in the inner side surface, with which the inlet end of the ice making duct 24 is in close contact, of the case 21.

The ice making duct 24, as shown in the figure, can laterally extend a predetermined length. That is, the ice making duct 24 can extend a predetermined length from a side surface to the other side surface of the ice making chamber 201.

The rear side of the ice making duct 24 is open, so cold air that is supplied through the supply duct 26 is guided to the rear side of the ice maker assembly 30 by the ice making duct 24.

The ice maker assembly 30 may be mounted below the ice making duct 24. An ice tray 31 that is defined as a component of the ice maker assembly 30 is disposed below the ice making duct 24 and a cold air guide 35 that is defined as a component of the ice maker assembly 30 is mounted on the bottom of the ice tray 31.

In detail, the cold air guide 35 functions as a cold air channel along which some of the cold air discharged from the ice making duct 24 flows and an outlet of the cold air guide 35 communicates with the inlet end of the exhaust duct 25 disposed at the inner side of the side wall of the case 21.

The inlet end of the exhaust duct 25 may be formed at a predetermined distance below the outlet end of the supply duct 26. The flow of the cold air that is guided to the ice making compartment 20 will be described below in detail with reference to the drawings.

As shown in FIGS. 2 and 3, when the ice bin 23 is installed in the ice making chamber 201, the cold air guide 35 is positioned lower than the top of the ice bin 23. That is, the cold air guide 35 is accommodated in the upper space of the ice bin 23. According to this structure, the upper ends of the side surfaces of the ice bin 23 may be cut or recessed a predetermined depth so that the cold air guide 35 is in close contact with the inner sides of the case 21 that define the ice making chamber 201. However, it may not be necessary to cut the upper ends of the side surfaces of the ice bin 23 by positioning the bottom of the cold air guide 35 at the same height as or higher than the open top of the ice bin 23.

Figure 4:
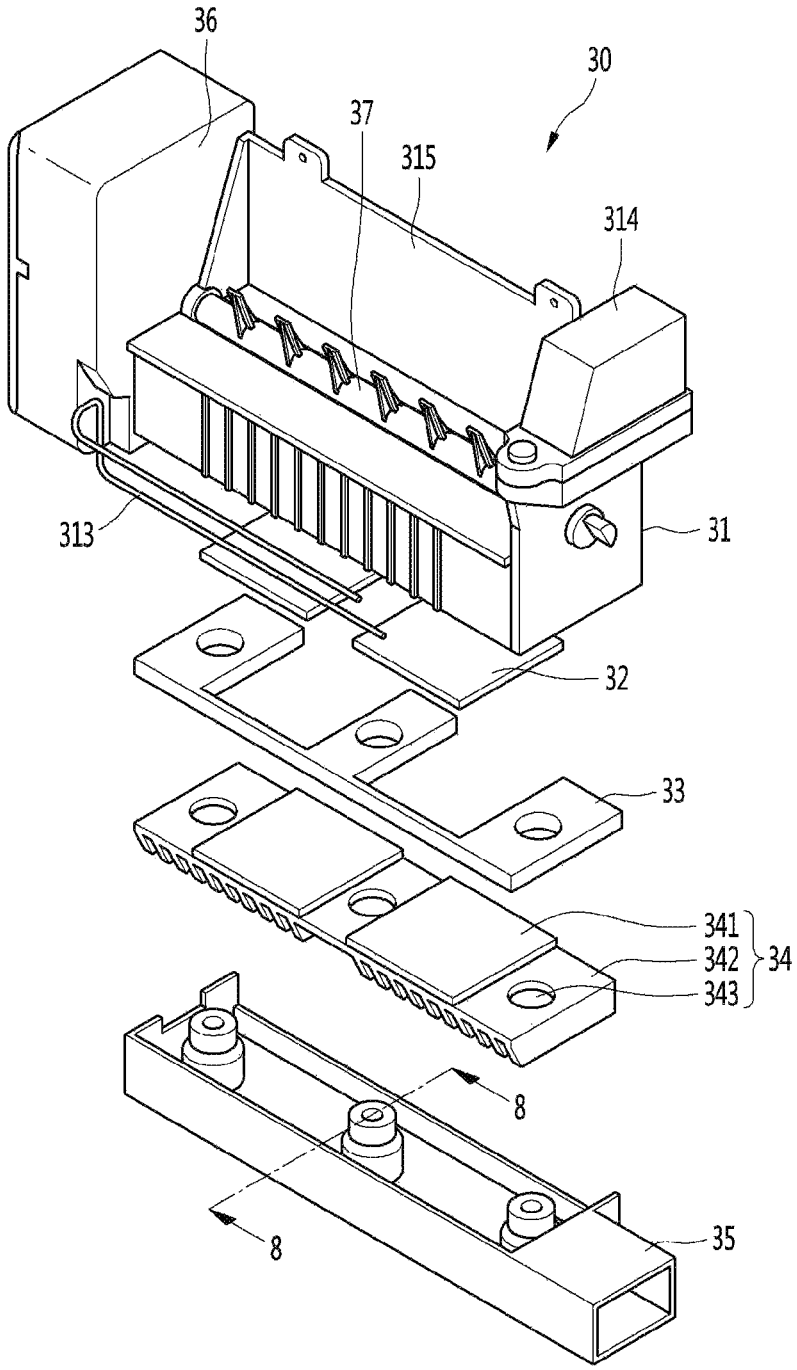
FIG. 4 is an exploded perspective view of an ice maker assembly that is mounted in the ice making compartment of the refrigerator according to an embodiment of the present invention.

FIG. 4 is an exploded perspective view showing the ice maker assembly that is mounted in the ice making compartment of the refrigerator according to an embodiment of the present invention.

Referring to FIG. 4, the ice maker assembly 30 according to an embodiment of the present invention may include: a ice tray 31 divided into a plurality of cells to make ices therein; an ejector 37 including a rotary shaft connecting the upper ends of the left side surface and the right side surface of the ice tray 31 and a plurality of ejecting pins extending on the outer side surface of the rotary shaft; a motor assembly 36 mounted on a side surface of the ice tray 31 and rotating the ejector 37; a thermoelectric module 32 mounted on the bottom of the ice tray 31; a heat dissipating member 34 mounted on the bottom of the thermoelectric module 32; a heat insulating member 33 disposed between the heat dissipating member 34 and the bottom of the ice tray 31; and the cold air guide 35 mounted on the bottom of the ice tray 31 and accommodating the thermoelectric module 32, the heat insulating member 33, and the heat dissipating member 34 therein.

In detail, a bracket 315 may further extend upward from the upper end of the rear side of the ice tray 31. Fasteners passing through the upper portion of the bracket 315 are inserted in the portion of the door liner that defines the rear side of the ice making chamber 201. Accordingly, the ice tray 31 is fixed in the ice making chamber 201. The bracket 315 is spaced a predetermined distance apart from the rear surface of the ice making chamber 201, thus some of the cold air discharged from the ice making duct 24 can flow down into the cold air guide 35 through the space or gap between the rear surface of the ice making chamber 201 and the bracket 315. Further, some of the cold air discharged from the ice making duct 24 flows down along the front surface of the bracket 325 and cools water in the cells of the ice tray 31. The cold air contacting the water in the cells flows down into the ice bin 23. The cold air flowing in the ice bin 23 maintains the ice cubes in the ice bin 23 under a freezing temperature, thereby preventing the ice cubes from melting and sticking to each other.

Meanwhile, an ice-full sensing lever 313 may be mounted on a side surface of the motor assembly 36. Further, the ice-full sensing lever 313 is positioned in the upper space of the ice bank 23, so it senses whether the ice bin 23 becomes full of ices.

A water supply unit 314 may be mounted on the upper end of a side surface of the ice tray 31, in detail, on the upper end of the side surface formed opposite to the motor assembly 365.

When a current is supplied to the thermoelectric module 32, a surface thereof functions as a heat absorbing side and the other surface functions as a heat dissipating side, and it is called a thermoelectric element. When the direction of the current that is supplied is changed, the heat absorbing surface changes to a heat dissipating surface and the heat dissipating surface changes to a heat absorbing surface. The thermoelectric module 32 is a well-known element, so it is not described anymore.

One or a plurality of thermoelectric modules 32 may be mounted on the bottom of the ice tray 31. The upper surface of the thermoelectric module 32 that is in contact with the bottom of the ice tray 31 functions as a heat absorbing surface in an ice making process and functions as a heat dissipating surface in an ice separating process. To this end, the flow direction of a current that is supplied to the thermoelectric module 32 should be changed in the ice making process and the ice separating process.

Further, the heat dissipating member 34 is mounted on the bottom of the thermoelectric module 32. The heat dissipating member 34, which is a member for transmitting heat from the thermoelectric module 32, is disposed in the cold air guide 35. Accordingly, when the cold air flowing in the cold air guide 35 is higher in temperature than the heat dissipating member 34, the temperature of the cold air that flows into the cold air guide 35 increases through heat exchange. On the contrary, when the heat dissipating member 34 is lower in temperature than the cold air flowing into the cold air guide 35, the temperature of the cold air flowing into the cold air guide 35 would decrease through heat exchange.

The heat dissipating member 34 may include a heat dissipating plate 341 being in direct contact with the bottom of the thermoelectric module 32 and heat dissipating fins 342 attached to the bottom of the heat dissipating plate 341. The heat dissipating plate 341 and the heat dissipating fins 342 may be formed in a single member and may be made of metal having high heat conductivity such as aluminum. A plurality of fastening holes 343 may be formed at the heat dissipating fins 342.

The heat insulating member 33 such as Styrofoam is disposed between the heat dissipating member 34 and the bottom of the ice tray 31, thereby preventing direct heat exchange between the bottom of the ice tray 31 and the top of the heat dissipating member 34.

In detail, in the ice making process, the heat dissipating member 34 absorbs heat from the thermoelectric module 32, so it is maintained at a relatively high temperature. If the ice tray 31 and the heat dissipating member 34 can exchange heat with each other, the heat absorbed to the heat dissipating member 34 transfers to the ice tray 31, so the ice making effect may be decreased. Accordingly, the heat insulating member 33 is provided to prevent direct heat exchange between the bottom of the ice tray 31 and the heat dissipating member 34.

The thermoelectric module 32 may have a size corresponding to the size of the bottom of the ice tray 31. In this case, a single thermoelectric module 32 may be mounted on the bottom of the ice tray 31.

Alternatively, as shown in the figures, a plurality of thermoelectric modules 32 that is smaller in size than the bottom of the ice tray 31 may be mounted on the bottom of the ice tray 31. In this case, a plurality of thermoelectric modules 32 may be arranged with predetermined gaps on the bottom of the ice tray 31. The heat dissipating plate 341 that is mounted on the bottom of the thermoelectric module 32 may also be provided in the same size and number as the thermoelectric module 32.

Figure 5:
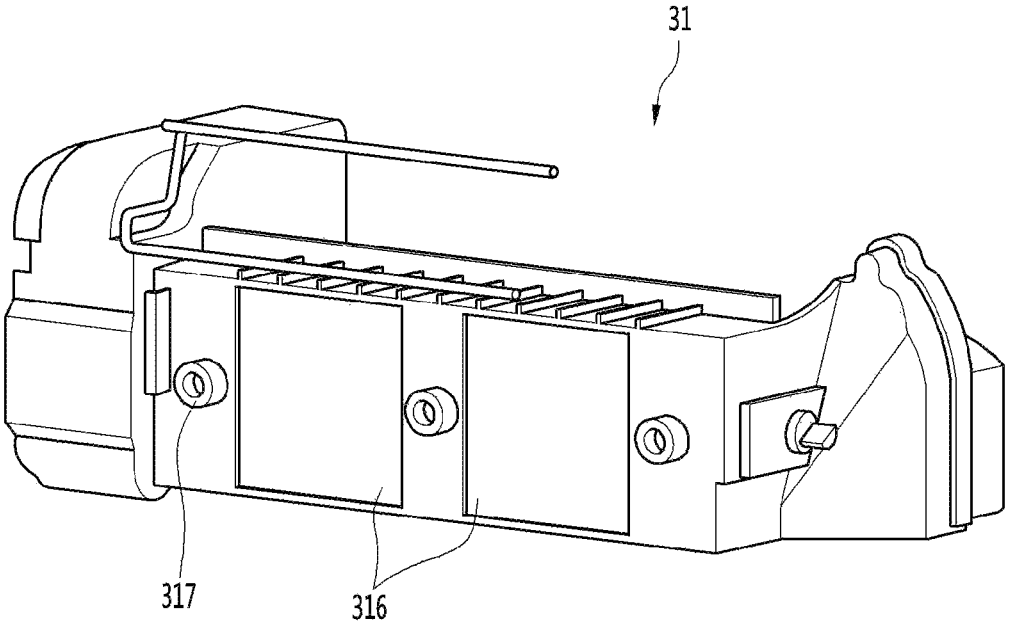
FIG. 5 is a bottom perspective view of an ice tray of the ice maker assembly according to an embodiment of the present invention.

FIG. 5 is a bottom perspective view of the ice tray of the ice maker assembly according to an embodiment of the present invention.

Referring to FIG. 5, thermoelectric module mounting portions 316 in which thermoelectric modules are disposed may be formed on the bottom of the ice tray 31 of the ice maker assembly 30 according to an embodiment of the present invention.

In detail, the thermoelectric module mounting portions 316 may be recessed a predetermined depth from the bottom of the ice tray 31. Since the thermoelectric module mounting portions 316 are recessed, the thermoelectric modules 32 can be stably fixed on the bottom of the ice tray 31 and can be prevented from horizontally shaking after they are mounted. Further, there is the advantage that the thermoelectric modules 32 are mounted at accurate positions.

A plurality of fastening bosses 317 may protrude from the bottom of the ice tray 31, between the thermoelectric modules 32.

Figure 6:
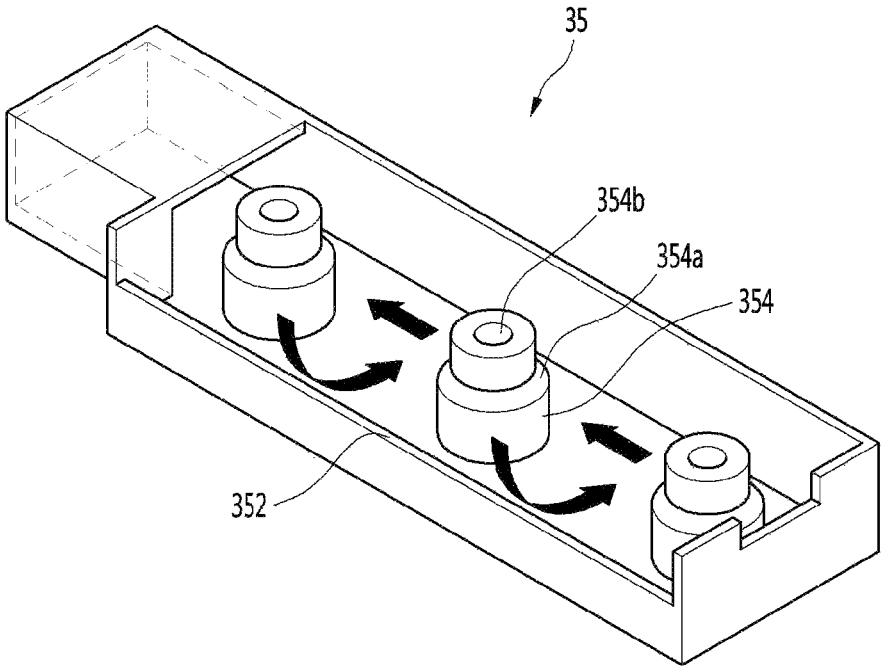
FIG. 6 is a rear perspective view of a cold air guide of the ice maker assembly according to an embodiment of the present invention.
Figure 7:
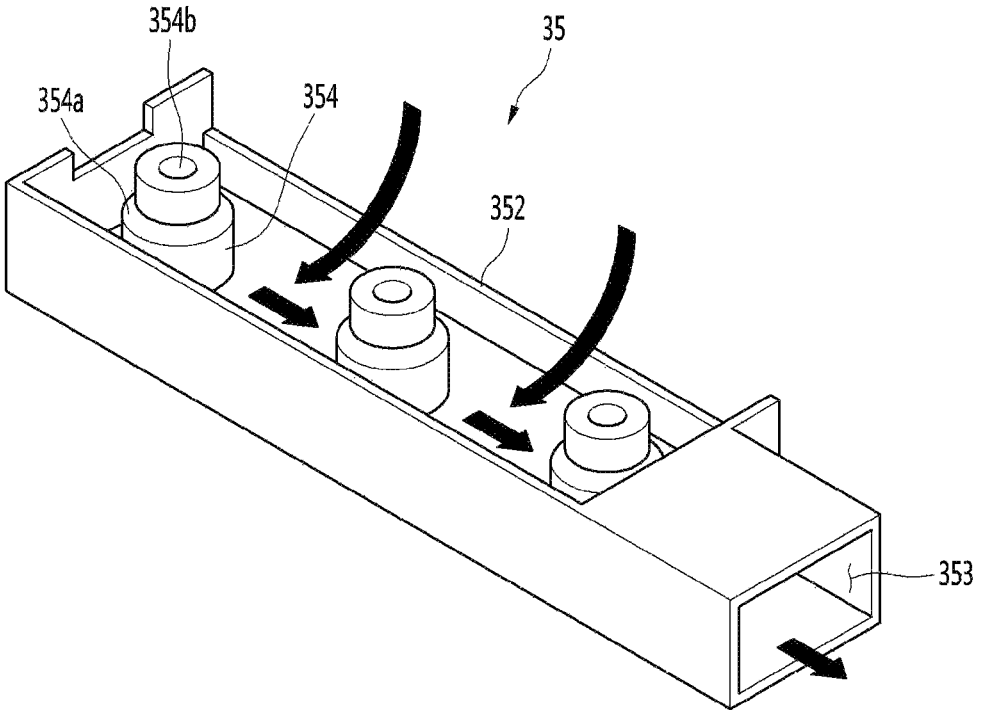
FIG. 7 is a front perspective view of the cold air guide.

FIG. 6 is a rear perspective view of the cold air guide of the ice maker assembly according to an embodiment of the present invention and FIG. 7 is a front perspective view of the cold air guide.

Referring to FIGS. 6 and 7, the cold air guide 35 of the ice maker assembly 30 according to an embodiment of the present invention is mounted on the bottom of the ice tray 31.

In detail, the cold air guide 35 may be formed in a duct shape with an empty inside. For example, as shown in the figures, the cold air guide 35 may be formed in a rectangular parallelepiped shape accommodating a heat dissipating element therein and having a space through which cold air can flow.

In more detail, a cold air inlet 352 is formed on the rear side of the cold air guide 35 so that cold air that is discharged from the ice making duct 24 and then flows down along the rear side of the bracket 315 of the ice tray 31 flows into the cold air guide 35.

A cold air outlet 353 is formed on a side surface of the cold air guide 35 so that the cold air flowing in the cold air guide 35 is discharged. The cold air outlet 353 communicates with the inlet end of the exhaust duct 25 formed in the side surface of the case 21. Accordingly, the cold air that is discharged through the cold air outlet 353 returns to the freezer compartment or the evaporation compartment through the exhaust duct 25 and the cold air return duct 15.

A plurality of fastening bosses 354 protrude from the bottom inside the cold air guide 35 and is coupled to the fastening bosses 317 of the ice tray 31 by fastening members.

In detail, a stepped portion 354*a* is formed on the outer circumferential surface of each of the fastening bosses 354 and a fastening hole 354*b* is formed through the top of each of the fastening bosses 354. The stepped portions 354*a* are formed to keep the heat dissipating member 34 spaced from the bottom of the cold air guide 35 and are described in detail with reference to the following cross-sectional view.

Figure 8:
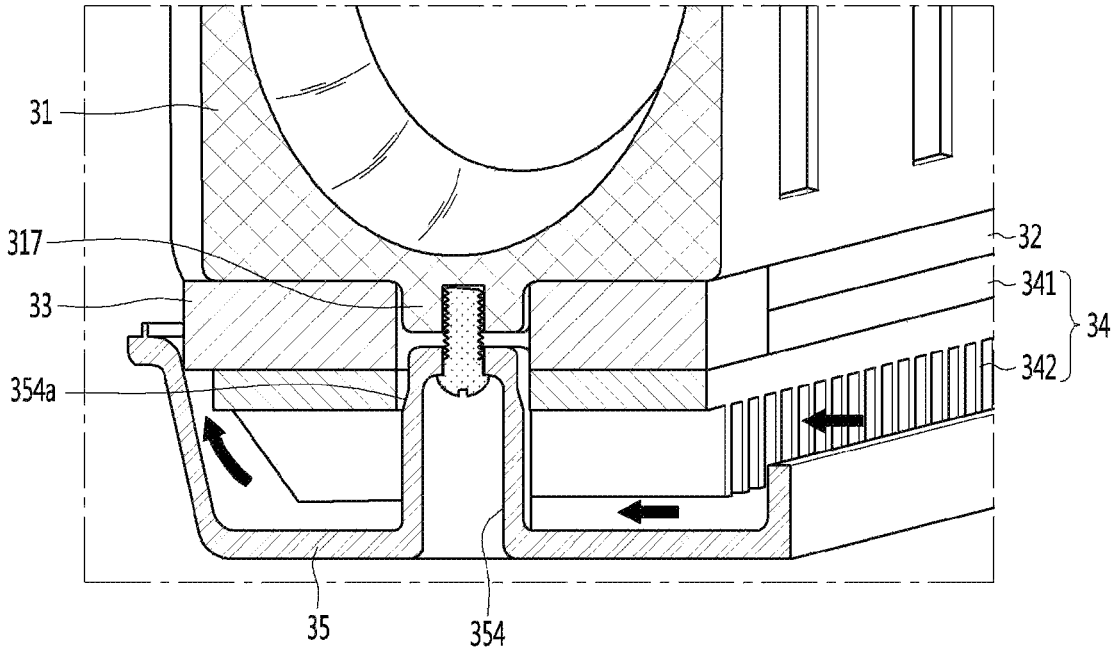
FIG. 8 is a vertical cross-sectional view taken along line 8-8 of FIG. 4.

FIG. 8 is a vertical cross-sectional view taken along line 8-8 of FIG. 4.

Referring to FIG. 8, a fastening boss 354 protruding upward from the bottom inside the cold air guide 35 and a fastening boss 317 extending downward from the bottom of the ice tray 31 are coupled to each other by a fastening member.

The top of the fastening boss 354 and the bottom of the fastening boss 317 are connected to each other with a gap therebetween by the fastening member without being in direct contact with each other. This is for preventing heat exchange between the ice tray 31 and the cold air guide 35 through the fastening bosses 317 and 354. Further, it is possible to avoid direct contact between the ends of the fastening bosses 317 and 354 by appropriately setting the thickness of the heat dissipating member 33.

The diameter of the fastening hole 343 formed at the heat dissipating member 34 may be determined such that the fastening hole 343 is stopped on the stepped portion 354*a* of the fastening boss 354. That is, the diameter of the fastening hole 343 may be smaller than the outer diameter of the stepped portion 354*a*.

When the heat dissipating fins 342 are stopped on the stepped portions 354*a*, the lower ends of the heat dissipating fins 342 are spaced a predetermined distance apart from the bottom inside the cold air guide 35. Accordingly, a passage that allows for flow of cold air can be formed between the lower ends of the heat dissipating fins 342 and the bottom inside the cold air guide 35.

Further, since the heat dissipating fins 342 are not in contact with the bottom inside the cold air guide 35, heat transferring to the heat dissipating fins 342 does not transfer to the cold air guide 35. Therefore, it is possible to prevent the heat transferring to the heat dissipating fins 342 in the ice making process from diffusing to the ice making chamber 201 through the air cold guide 35.

Further, since the heat insulating member 33 is disposed between the bottom of the ice tray 31 and the heat dissipating fins 342, direct heat exchange between the ice tray 31 and the heat dissipating fins 342 can be prevented.

The heat dissipating plate 341 is attached directly to the bottom of the thermoelectric module 32. In the ice making process, the top of the thermoelectric module 32 that is in contact with the bottom of the ice tray 31 functions as a heat absorbing surface and the bottom that is the opposite side functions as a heat dissipating surface. Accordingly, heat that is generated from the heat dissipating surface of the thermoelectric module 32 transfers to the heat dissipating member 34 in the ice making process.

In contrast, in the ice separating process, the top of the thermoelectric module 32 functions as a heat dissipating surface and the bottom thereof functions as a heat absorbing surface. Accordingly, the ice tray 31 is heated by the heat from the heat dissipating surface of the thermoelectric module 32, so ices made in the cells of the ice tray 31 are separated from the inner circumferential surfaces of the cells, whereby ice separation becomes easy.

Figure 9:
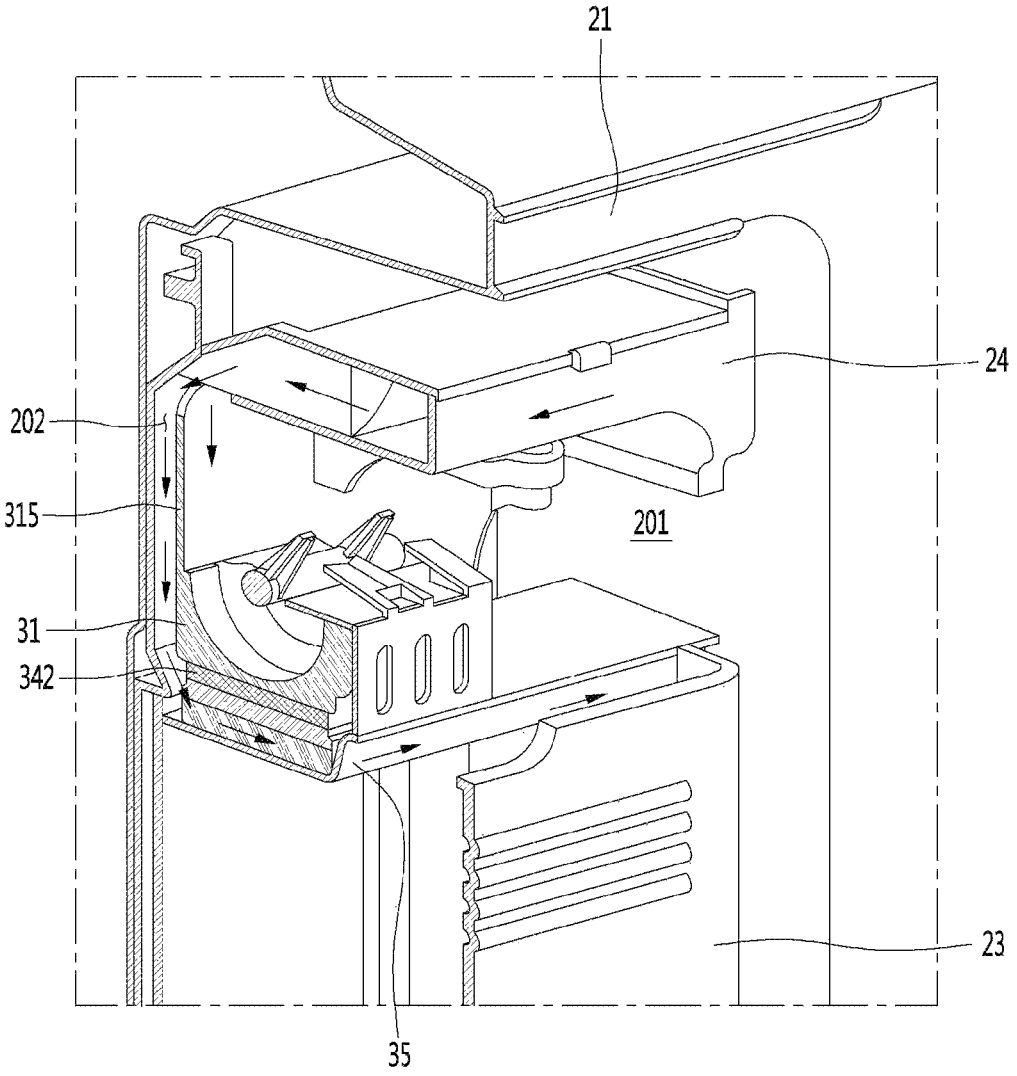
FIG. 9 is a cross-sectional perspective view showing the flow of cold air that is supplied to the ice making compartment of the refrigerator according to an embodiment of the present invention.

FIG. 9 is a cross-sectional perspective view showing the flow of cold air that is supplied to the ice making compartment of the refrigerator according to an embodiment of the present invention.

Referring to FIG. 9, cold air produce in the evaporation compartment of the refrigerator 10 flows into the ice making chamber 201 through the cold air supply duct 4 and the supply duct 26. The cold air is discharged rearward from the upper portion of the ice making chamber 201 through the ice making duct 24 mounted in the ice making chamber 201.

In detail, the bracket 315 extending from the rear side of the ice tray 31 is fixed to the rear side of the ice making chamber 201 with a predetermined gap therebetween. A cold air descent channel 202 is formed between the rear side of the ice making chamber 201 and the bracket 315. The lower end of the cold air descent channel 202 is connected to the cold air inlet 352 formed on the rear side of the cold air guide 35.

In detail, the cold air discharged from the ice making duct 24 is guided behind the ice making chamber 201 and some of the cold air guided behind the ice making chamber 201 flows down through the cold air descent channel 202 and then flows into the cold air guide 35. Further, the cold air descending along the front side of the bracket 315 exchanges heat with the water in the cells of the ice tray 31 by coming in contact with the water and then flows into the ice bin 23.

A separate cold air outlet (not shown) may be further formed on a side wall surface of the case 21 and may communicate with the exhaust duct 25 to return the cold air in the ice making chamber 201 to the freezer compartment or the evaporation compartment. Accordingly, the cold air that has increased in temperature by exchanging heat with the heat dissipating member 34 in the cold air guide 35 can be guided directly to the exhaust duct 25 without being mixed with the cold air in the ice making chamber 201 and the cold air in the ice making chamber 201 can also be guided to the exhaust duct 25.

The heat dissipating fins 342 are plate-shaped members spaced a predetermined distance apart from each other and arranged in parallel with each other. The cold air flowing into the cold air inlet 352 of the cold air guide 35 exchanges heat with the heat dissipating fins 342 while passing through cold air channels formed between adjacent heat dissipating fins 342.

Accordingly, the cold air channels formed between adjacent heat dissipating fins 342 extend toward the front side from the rear side of the cold air guide 35. In other words, the heat dissipating fins 342 are erected and extend in the front-rear direction of the cold air guide 35 and are spaced apart from each other in the left-right direction of the cold air guide 35.

According to this structure, the cold air flowing in the cold air guide 35 through the cold air inlet 352 flows to the front side of the cold air guide 35 and is then turned 90 degrees by the front side of the cold air guide 35. That is, the flow direction of the cold air hitting against the front side of the cold air guide 35 is changed to the cold air outlet 353.

As described above, since the thermoelectric module 32 is mounted on the bottom of the ice tray 31, cooling is performed by the thermoelectric module in addition to the cold air that is supplied to the ice making compartment, so the ice making time is reduced. Accordingly, when rapid ice making is required, it is possible to make ices within a short time by operating the thermoelectric module 32. To this end, a rapid ice making menu may be added and a rapid ice making selection button may be provided on a control panel.

Further, in the rapid ice making mode, the heat from the thermoelectric module 32 is directly sent to the freezer compartment or the evaporation compartment without diffusing into the ice making compartment, so it is possible to prevent ices from sticking to each other due to an increase in temperature of the ice making compartment.

Meanwhile, it should be noted that the ice making compartment 20 described above can be mounted not only on the rear side of the refrigerator compartment door, but in the refrigerator compartment 111.

In other words, the ice making compartment 20 may be mounted on the upper edge of the refrigerator compartment 111, and the ice maker assembly 30 and the ice bin 23 may be mounted in the ice making compartment 20. When the ice making compartment 20 is mounted in the refrigerator compartment 111, the height of the ice bin 23 may be reduced and the width and length of the ice bin 23 may be changed.

Further, the inlet end of the ice making duct 24 may be coupled to the rear side of the ice making compartment 20, the ice making duct 24 may be elongated forward from the ice making compartment 20, and an outlet may be formed on a side surface of the ice making duct 24.

The ice tray 31 may be mounted in the ice making compartment 20 to be elongated in the front-rear direction of the ice making compartment 20. The cold air inlet 352 of the cold air guide 35 may be open toward an inner side of the ice making compartment 20, that is, a side surface of the refrigerator compartment 111, and the cold air outlet 353 may be in close contact with the rear side of the ice making compartment 20.

The cold air supply duct 14 and the cold air return duct 25 may extend along the rear side of the refrigerator compartment 111. The inlet end of the supply duct 14 may communicate with the evaporation compartment and the outlet end thereof may communicate with the inlet end of the ice making duct 24. The inlet end of the cold air return duct 15 may communicate with the cold air outlet 353 and the outlet end thereof may communicate with the evaporation compartment.

That is, it can be considered in FIG. 9 that the ice making compartment 20 is designed in the refrigerator compartment 111 such that the inlet end of the ice making duct 24 is in close contact with the rear side of the refrigerator compartment. Further, an ice outlet may be formed at the edge between the front side and the bottom of the ice making compartment 20 so that the inlet end of the discharge duct of the refrigerator compartment door 12 communicates with the ice outlet of the ice making compartment 20 when the refrigerator compartment door 12 is in a closed position.

The invention claimed is:

1. A refrigerator comprising:

a cabinet having a storage space and an evaporation compartment therein;

a door coupled to a front side of the cabinet and configured to open and close at least a portion of the storage space;

an ice making compartment mounted in the storage space or on a rear side of the door, the ice making compartment comprising a case that defines an ice making chamber therein;

an ice tray disposed in the ice making compartment;

a bracket that extends upward from an upper end of a rear side of the ice tray, that is spaced apart from a rear surface of the ice making chamber, and that defines a cold air descent channel between the rear surface of the ice making chamber and the bracket;

an ice bin disposed below the ice tray;

a dispenser disposed on the front side of the door to dispense ices;

a discharge duct disposed in the door and having an inlet end communicating with the ice making compartment and an outlet end communicating with the dispenser;

a supply duct disposed inside of a side wall of the case and configured to supply cold air to the ice making chamber;

an exhaust duct disposed in the side wall of the case and configured to discharge cold air in the ice making chamber;

an ice making duct disposed in an upper portion of the ice making chamber above the ice tray, the ice making duct being configured to communicate with the supply duct and to discharge cold air rearward from the upper portion of the ice making chamber;

a thermoelectric module having a first side surface in contact with a bottom of the ice tray;

a heat dissipating member that is in contact with a second side surface of the thermoelectric module; and a cold air guide disposed at the bottom of the ice tray, the cold air guide having:

a space that accommodates the thermoelectric module and the heat dissipating member, a cold air inlet configured to communicate with a lower end of the cold air descent channel, and a cold air outlet configured to communicate with the exhaust duct, wherein the ice making duct is configured to discharge (i) a first portion of cold air to the cold air descent channel to cool the heat dissipating member and (ii) a second portion of cold air toward the front surface of the bracket.

2. The refrigerator of claim 1, wherein the ice making compartment is mounted on the rear side of the door.

3. The refrigerator of claim 2, wherein the ice making compartment includes:

an ice making compartment door coupled to the case to open or close the ice making chamber.

4. The refrigerator of claim 1, wherein the ice making duct comprises:

an outlet end that is open toward the rear side of the ice making chamber and that is configured to discharge the first portion of cold air and the second portion of cold air;

an upper rear end connected to the rear surface of the ice making chamber and configured to guide the first portion of cold air from the outlet end to the cold air descent channel; and a lower rear end spaced apart from an upper end of the bracket and configured to discharge the second portion of cold air from the outlet end to the front surface of the bracket.

5. The refrigerator of claim 1, further comprising:

a cold air supply duct disposed inside of a side wall of the cabinet and configured to communicate with the supply duct based on the door being closed; and a cold air return duct disposed inside of the side wall of the cabinet and configured to communicate with the exhaust duct based on the door being closed.

6. The refrigerator of claim 1, wherein further comprising a heat insulating member disposed between the thermoelectric module and the heat dissipating member.

7. The refrigerator of claim 1, wherein the ice tray comprises a mounting portion recessed from the bottom of the ice tray and configured to receive the thermoelectric module.

8. The refrigerator of claim 1, wherein the heat dissipating member includes:

a heat dissipating plate attached to the thermoelectric module; and heat dissipating fins coupled to a bottom of the heat dissipating plate.

9. The refrigerator of claim 1, wherein the storage space is a refrigerator compartment, and wherein the cabinet further includes a freezer compartment disposed below the refrigerator compartment.

10. The refrigerator of claim 1, wherein the bracket partitions an inner space of the case into the ice making chamber and the cold air descent channel that is disposed rearward relative to the ice making chamber, the upper portion of the ice making chamber being in communication with an upper portion of the cold air descent channel, and wherein an upper end of the bracket faces the upper portions of the ice making chamber and the cold air descent channel, and is spaced apart from the ice making duct to divide cold air guided through the ice making duct into the first portion of cold air and the second portion of cold air.

11. The refrigerator of claim 10, wherein the cold air descent channel extends in a vertical direction, and the ice making duct extends in a horizontal direction, and wherein the front surface of the bracket and a bottom surface of the ice making duct face the ice making chamber.

12. The refrigerator of claim 1, wherein the case is disposed at the rear side of the door.

13. The refrigerator of claim 1, wherein the cold air descent channel is configured to guide the first portion of cold air downward to the heat dissipating member to cool the heat dissipating member, and wherein the front surface of the bracket is configured to guide the second portion of cold air downward to the ice tray to exchange heat with water in the ice tray.

* * * * *